US007648393B2

(12) United States Patent
Burris et al.

(10) Patent No.: US 7,648,393 B2
(45) Date of Patent: Jan. 19, 2010

(54) COAXIAL CABLE CONNECTOR WITH EXTERNAL CLIP

(75) Inventors: Donald Andrew Burris, Peoria, AZ (US); William Bernard Lutz, Glendale, AZ (US)

(73) Assignee: Corning Gilbert Inc., Glendale, AZ (US)

( * ) Notice: Subject to any disclaimer, the term of this patent is extended or adjusted under 35 U.S.C. 154(b) by 0 days.

(21) Appl. No.: 11/895,314

(22) Filed: Aug. 24, 2007

(65) Prior Publication Data

US 2009/0053930 A1 Feb. 26, 2009

(51) Int. Cl.
*H01R 9/05* (2006.01)

(52) U.S. Cl. ..... 439/578

(58) Field of Classification Search ..... 439/578, 439/584, 585

See application file for complete search history.

(56) References Cited

U.S. PATENT DOCUMENTS 4,722,136 A 2/1988 Justiano et al. ..... 29/837
7,153,159 B2 12/2006 Burris et al. ..... 439/578
7,326,079 B2 * 2/2008 Holliday et al. ..... 439/578
2006/0009073 A1 1/2006 Holliday ..... 439/578
2006/0189188 A1 8/2006 Holliday et al. ..... 439/198

OTHER PUBLICATIONS

Leviton QuickPort® Compression connectors, Part No. 40782-CPF and associated literature, http://cableorganizer.com/leviton/quickport-snap-in-bulkhead-connectors.htm, pp. 1-3, Oct. 20, 2007.

Leviton QuickPort® Compression connectors, Part No. 40782-CPF and associated literature, http://www.broadbandutopia.com/levquicsnapc1.html, pp. 1-2, Oct. 21, 2007.

* cited by examiner

*Primary Examiner*—Alexander Gilman
(74) *Attorney, Agent, or Firm*—Joseph M. Homa; Mathew J. Mason

(57) ABSTRACT

A coaxial cable connector is provided with an external clip that can be installed on location rather than in a factory. An adapter is also provided that can be shipped with connector for securing the external clip on the coaxial cable connector and the connector on a coaxial cable. A method for assembling the connector, the clip and the cable is also disclosed.

15 Claims, 8 Drawing Sheets

COAXIAL CABLE CONNECTOR WITH EXTERNAL CLIP

BACKGROUND

The present invention relates generally to a coaxial cable connector with an external clip and an optional adapter used in axial compression.

Coaxial cable connectors such as Type F, RCA or BNC connectors are used to attach a coaxial cable to another object such as an appliance or junction having a terminal adapted to engage the connector. Such connectors must be attached to a coaxial cable using various cable preparation techniques and installation tools. Cable preparation typically requires removal of portion of the cable jacket, braid, outer conductor and core to expose the cable center conductor. Another portion of the cable jacket is removed to expose the cable braid. Cable preparation is completed by folding of the cable braid structure back against the remaining cable jacket. The cable is then inserted into the connector, after which the connector is activated to secure it to the coaxial cable.

In some known applications coaxial connectors are adapted to work in conjunction with a modular connector, or external clip, that is designed to engage a wall plate by means of a snap fit. Use of the modular clip provides a means to attach a coaxial cable connector installed on a cable to a wall plate to ensure both an attractive and convenient junction for corresponding equipment connectors and cables.

Known connectors are pre-assembled to the modular clip during factory assembly processes wherein an unassembled component, in particular the main body component, is inserted through a bore in a plastic colored clip and is pressed or snap fit into place. The remaining connector components are then assembled accordingly. Once assembled, a given connector and colored clip combination is permanently joined together thereby limiting the connector/clip color product offerings to one choice. If other color options are desired, it becomes necessary to build up a large number of connector/clip assembly combinations in various colors with various connector interfaces, resulting in large inventories that need to be kept on hand.

Once deployed into the field for assembly to cable, the known connector/clip offerings require the use of tooling adaptors to accommodate various connector interfaces such as Type F, RCA, BNC and the like, further complicating the tooling selection and assembly process for the technician.

Therefore, an adapter, a corresponding coaxial cable connector and modular external clips are needed that provide the users with a connector and clips that are easy to install and allows the user to chose the clips on the spot.

SUMMARY

Disclosed herein is a coaxial cable connector for attachment to a coaxial cable, the coaxial cable comprising a center conductor, a dielectric layer surrounding the center conductor, and an outer conductor surrounding the dielectric layer, the coaxial cable connector including a body having a front end, a back end, an external gripping portion, and a longitudinal opening extending between the front end and the back end along a longitudinal axis, a post fixedly mounted within the longitudinal opening in the body from the back end of the body, a contact assembly movably mounted to the post and capable of moving longitudinally relative to the body, the contact assembly capable of receiving the center conductor of the coaxial cable, and an external clip engaging at least a forward portion of the external gripping portion of the body and extending over the external gripping portion and toward the back end of the body.

In another aspect, a method of assembling a coaxial cable connector is disclosed, the method including the steps of providing a coaxial cable connector having a body with a front end, a back end, an external gripping portion, and a longitudinal opening extending between the front end and the back end along a longitudinal axis, inserting a post into the body from the back end of the body, inserting a contact assembly into the post so that the contact assembly is capable of moving longitudinally relative to the body, inserting a coaxial cable into the contact assembly of the coaxial cable connector, disposing an external clip over the front of the body of the coaxial cable connector, disposing an adapter over the front of the body of the coaxial, and axially compressing the adapter and the connector relative to one another thereby forcing the external clip into an annular groove in the body of the coaxial cable connector and axially compressing the coaxial cable connector to secure the coaxial cable in the coaxial cable connector.

Additional features and advantages of the invention will be set forth in the detailed description which follows and, in part, will be readily apparent to those skilled in the art from that description or recognized by practicing the invention as described herein, including the detailed description which follows, the claims, and the appended drawings.

It is to be understood that both the foregoing general description and the following detailed description of the present embodiments of the invention are exemplary and explanatory, and are intended to provide an overview or framework for understanding the nature and character of the invention as it is claimed. The accompanying drawings are included to provide a further understanding of the invention and are incorporated into and constitute a part of this specification. The drawings illustrate various embodiments of the invention and, together with the description, serve to explain the principles and operations of the invention.

DETAILED DESCRIPTION

Figure 1:
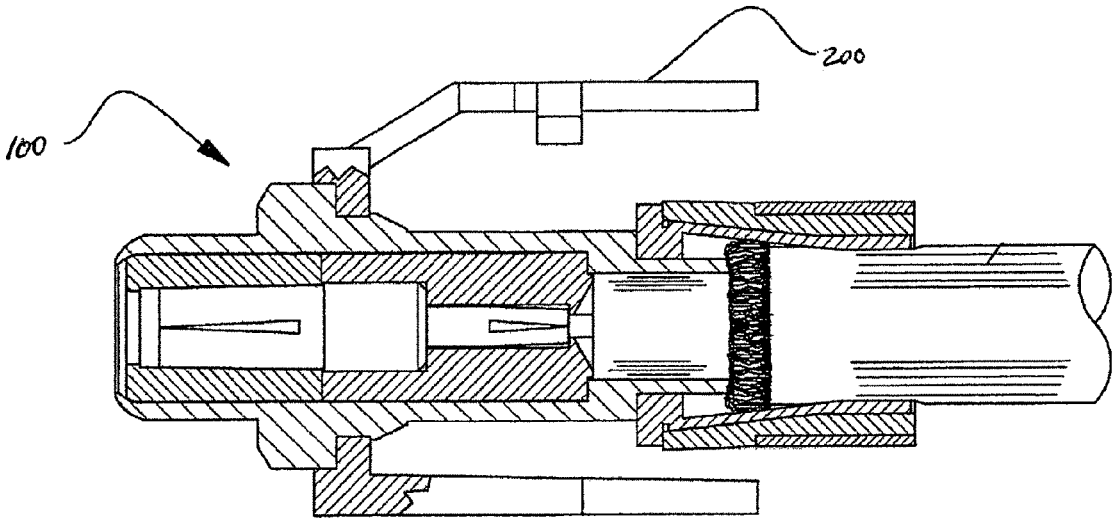
FIG. 1 is cross-sectional view of a known connector and external clip.
Figure 2A:
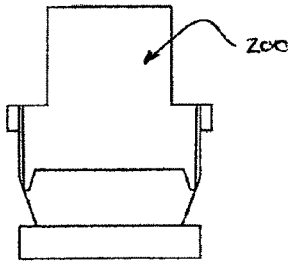
FIG. 2A is a top view of a known external clip.
Figure 2B:
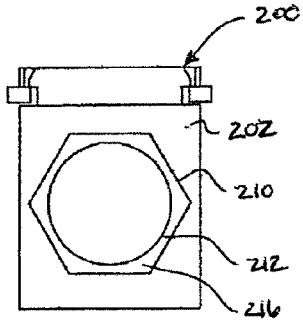
FIG. 2B is a front view of a known external clip.
Figure 2C:
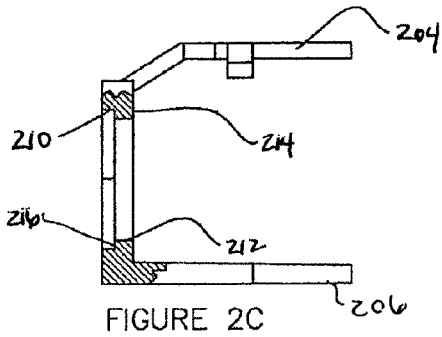
FIG. 2C is a partial cross-sectional side view of a known external clip.

Reference will now be made in detail to the present preferred embodiment(s) of the invention, examples of which are illustrated in the accompanying drawings. Whenever possible, the same reference numerals will be used throughout the drawings to refer to the same or like parts.

Referring to FIGS. 1-6, an axially-compressible connector 100 according to the prior art is illustrated. FIG. 1 shows the connector 100 with a prior art external clip 200 and a coaxial cable installed. As illustrated in FIGS. 2A-C, the clip 200 has a front face 202, a top flange 204, and a bottom flange 206. The front face 202 includes partially recessed hex 210, through-bore 212 disposed radially inward from the partially recessed hex 210 and extends completely through the front face 202, and a rear surface 214 opposite the front face 202. The partially recessed hex 210 also has a forward facing surface 216. The clip 200 is made of a resilient plastic.

Figure 3:
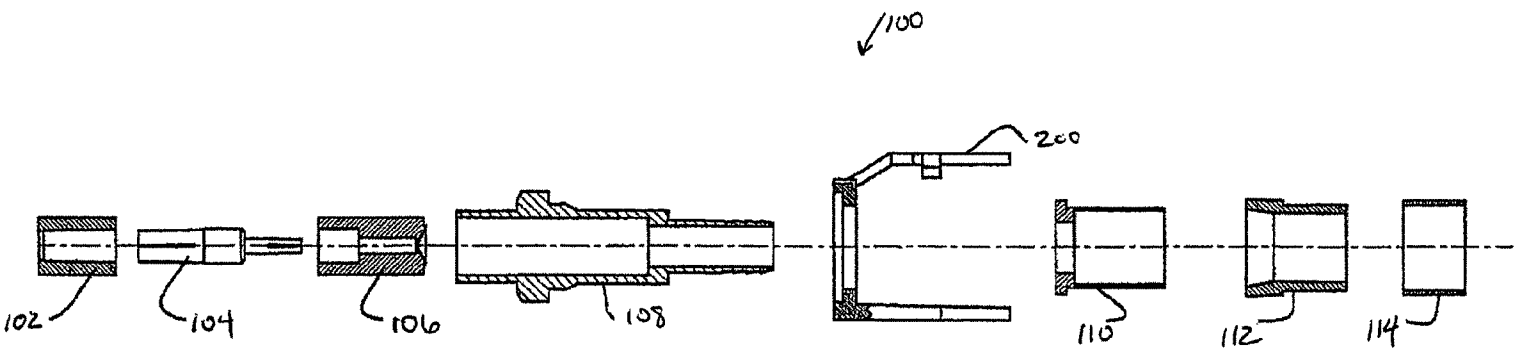
FIG. 3 is a cross-sectional view of the connector of FIG. 1 prior to assembly.
Figure 4:
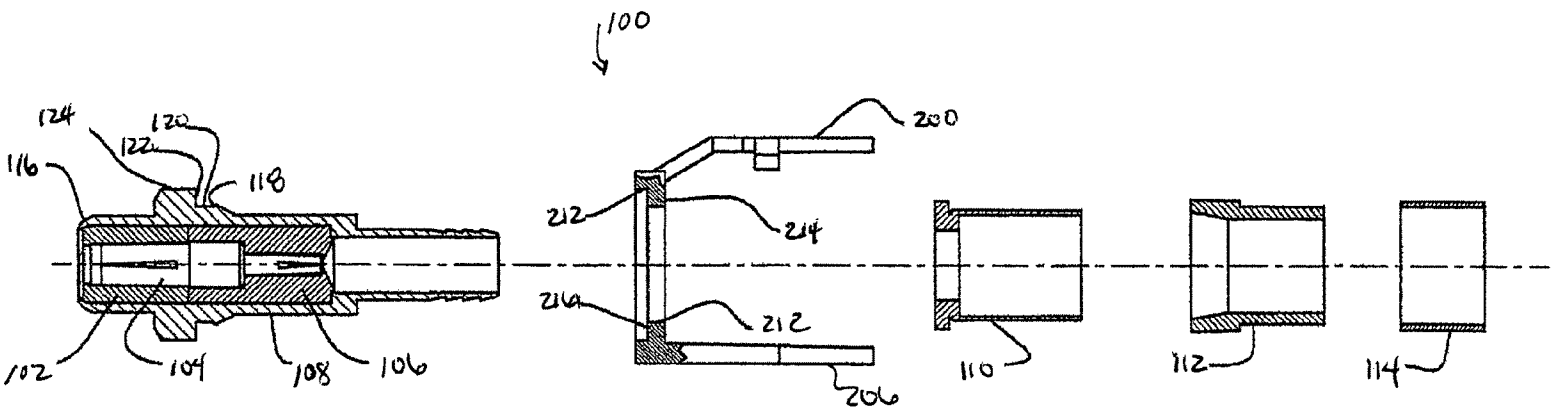
FIG. 4 is a cross-sectional view of the connector of FIG. 1 after a first stage of factory assembly.
Figure 5:
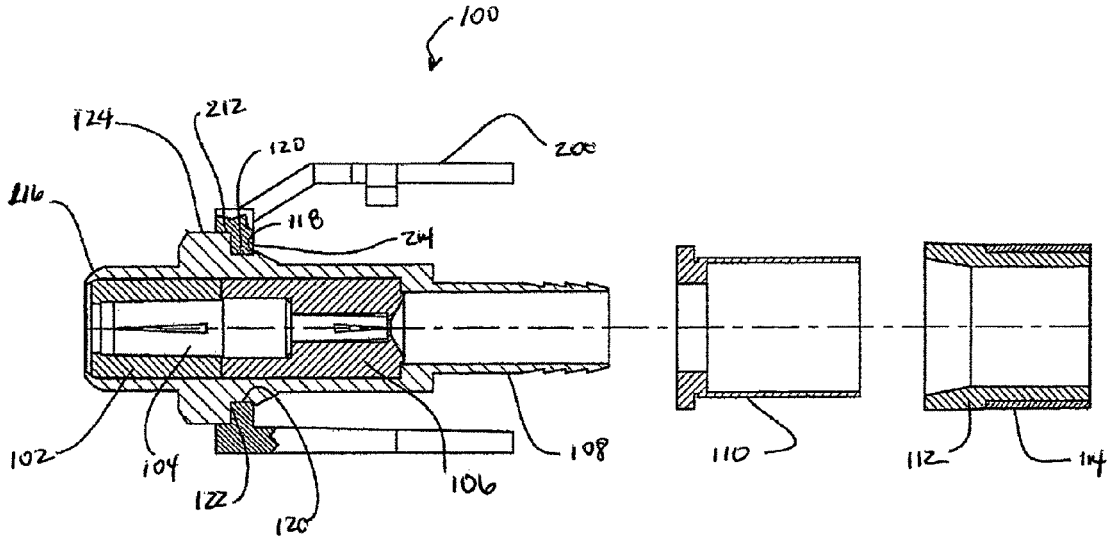
FIG. 5 is a cross-sectional view of the connector of FIG. 1 after a second stage of factory assembly.

Referring to FIG. 3, the prior art connector 100 includes a front insulator 102, contact 104, rear insulator 106, body 108, clip 200, member 110, compression ring 112, and sleeve 114. In order to assemble the connector 100, the front insulator 102, contact 104, and rear insulator 106 are inserted into body 108 at the factory. As illustrated in FIG. 4, the front end of the connector 100 is processed with special tools and procedures to seal the front insulator 102, contact 104, and rear insulator 106 in the body 108 with a roll over 116 at front end of the body 108.

Figure 6:
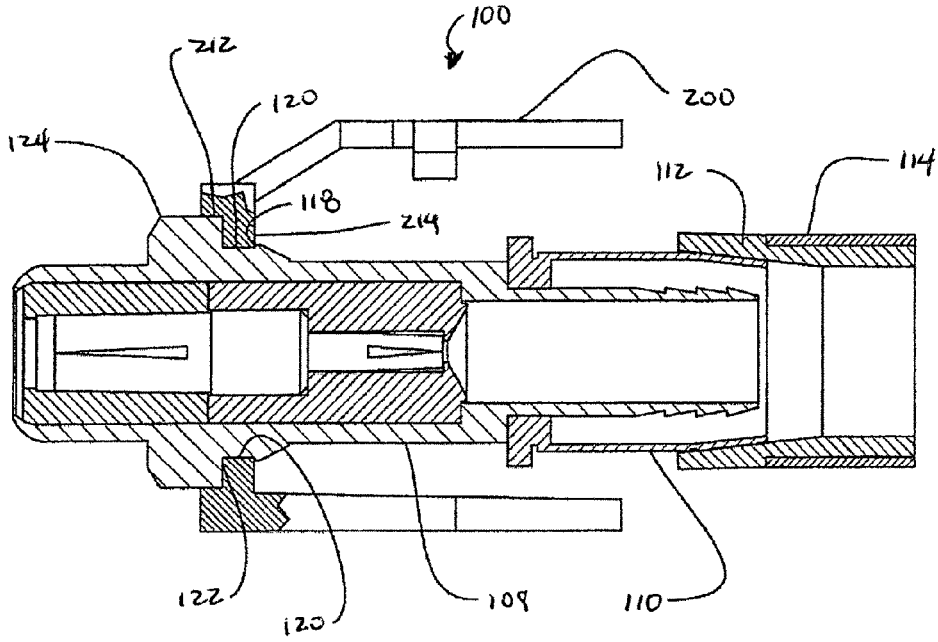
FIG. 6 is a cross-sectional view of the connector of FIG. 1 after a third stage of factory assembly.

The clip 200 is disposed over the rear portion of the connector 100 prior to the attachment of member 110, compression ring 112, and sleeve 114 to the already assembled portion of connector 100 since the outer diameter of those components is larger than the through-bore 212 of the clip 200. The clip 200, which is resilient, is pushed over a lip 118 on body 108 of connector 100. The through-bore 212 then constricts around the annular groove 120 and the forward facing surface 216 and partially recessed hex 210 engage a rearward facing surface 122 of external hex 124 and external hex 124 itself, respectively, of the body 108. See FIG. 5. The remaining components, member 110, compression ring 112, and sleeve 114, are then installed on body 108 in a factory using specialized tools and methods. The prior art connector 100 of FIG. 6 is then ready to be shipped out to the field. In this configuration, the clip 200 is determined in the factory and if the clip is not the right color for the application, the installer cannot change it, but must carry a number of connectors with different colors and also different connector configurations (e.g., Type F, RCA or BNC).

Figure 7:
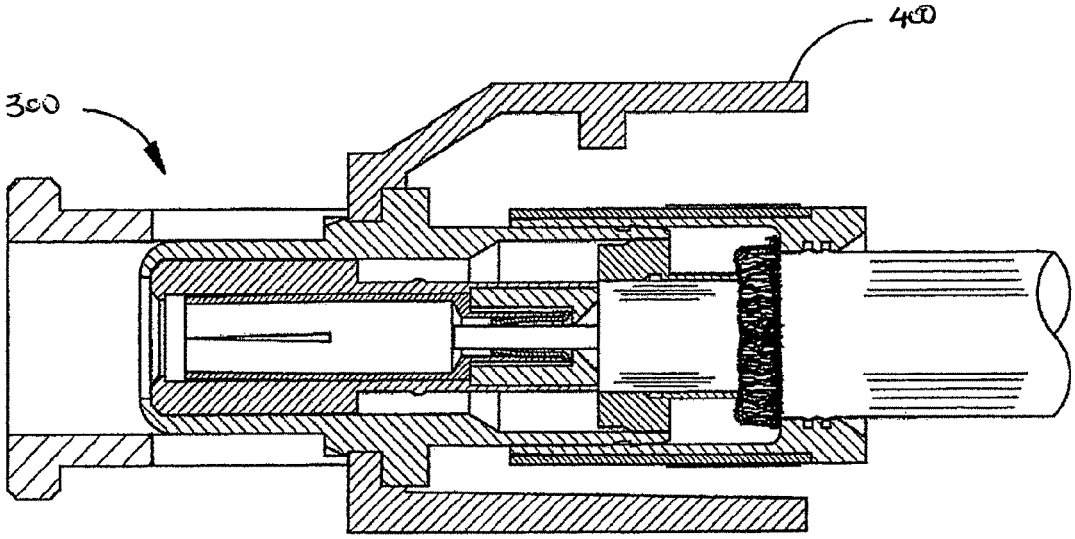
FIG. 7 is a cross-sectional view of one embodiment of an assembled coaxial cable connector with an external clip and an adapter according to the present invention.

An embodiment of a connector 300 according to the present invention is illustrated in FIG. 7. In connector 300, the internal components are inserted from the rear of the connector 300 while the clip 400 is inserted on the front portion of the connector 300.

Figure 8A:
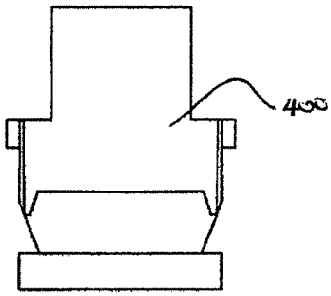
FIG. 8A is a top view of an external clip according to the present invention.
Figure 8B:
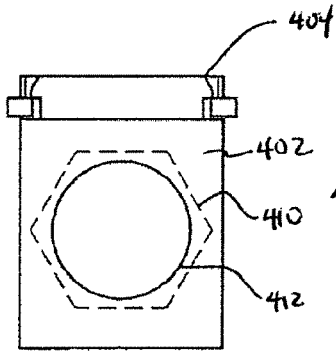
FIG. 8B is a front view thereof.
Figure 8C:
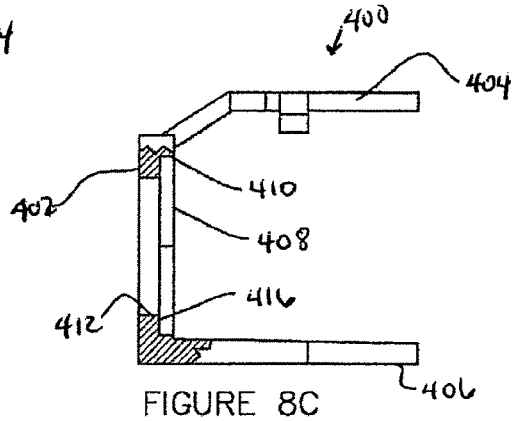
FIG. 8C is a partial cross-sectional side view thereof.

An embodiment of an external clip 400 according to the present invention is illustrated in FIGS. 8A-C. The clip 400 has a front face 402, a top flange 404, a bottom flange 406, and a rear face 408. The rear face 408 includes partially recessed engagement portion 410, through-bore 412 disposed radially inward from the partially recessed engagement portion 410 and extends completely through to the front face 402. The partially recessed engagement portion 410 also has a rearward facing surface 416. The partially recessed engagement portion 410 is illustrated as a partially recessed hex portion to engage a corresponding hex portion of the connector 300, but the recessed engagement portion 410 is preferably configured so that engages the corresponding structure of the external gripping portion on the connector 300, as discussed below. The clip 400 is also made of a resilient plastic. As indicated in FIG. 7, the clip 400 is attached to the connector 300 from the front end, thus the partially recessed engagement portion 410 must be on the rear face 408 in order to engage the external gripping portion as described in more detail below.

Figure 9:
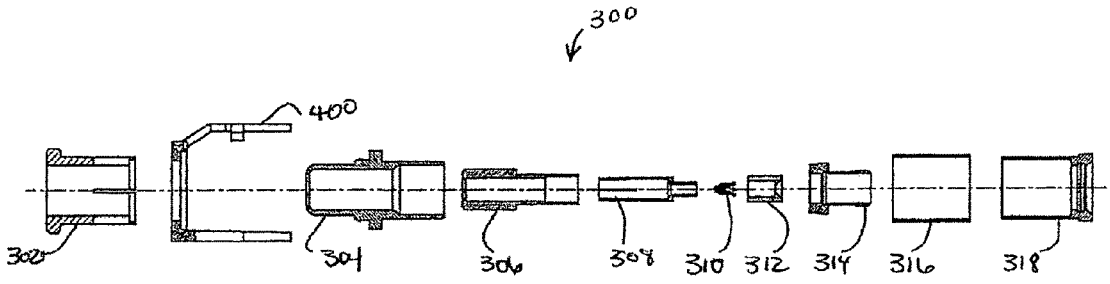
FIG. 9 is a cross-sectional view of the connector of FIG. 7 prior to assembly.
Figure 10:
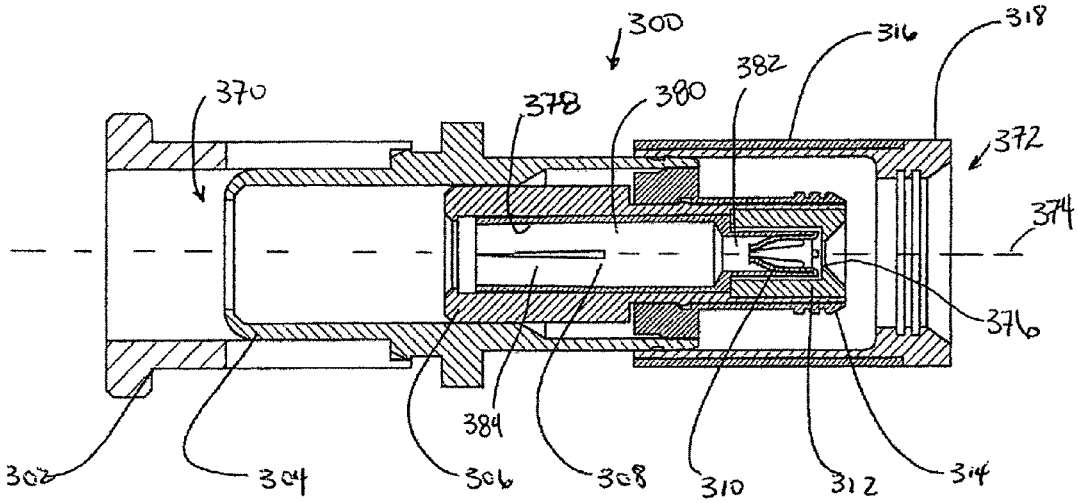
FIG. 10 is a cross-sectional view of the connector of FIG. 7 in ready-to-ship state.

FIG. 9 illustrates an exploded view of the axially-compressible connector 300 along with the clip 400, which in this embodiment of the invention takes the form of an RCA connector. The connector 300 preferably includes adapter 302, clip 400, body 304, front insulator 306, contact 308, inner contact 310, rear insulator 312, post 314, shell 316, and compression ring 318. All of the connector 300 components, except for the adapter 302 and the clip 400 are installed into the rear of the body 304, rather than from the front and the rear as in the prior art connector 100. In fact, the connector 300 is illustrated in FIG. 10 prior to use, such as during transport or shipment, in storage, or in a ready-to-be-shipped state. The connector 300 has a front end 370, a back end 372, and a central longitudinal axis 374. The front end 370 is configured to be removably attached to a terminal (not shown) having a male conductor and, as illustrated, may include an adapter 302 that allows the use of a single tool for multiple connectors to axially compress the connector, as discussed in more detail below. The back end 372 is for attachment to coaxial cable 300. The connector 300 also has a compression ring 318 that has a generally tubular shape and is preferably made from plastic. A tubular shaped shell 316 is mounted on the outside of the compression ring 318 and is preferably made of metal. The compression ring 318 is mounted onto a body 304, preferably by a press-fit and is preferably also made of metal. A generally tubular shaped post 314 is mounted within the body 304 and is also preferably made of metal. A generally tubular shaped rear insulator 312, which is preferably a dielectric, is mounted within the post 314. The compression ring 318, shell 316, body 304, post 314 and rear insulator 312 share the same longitudinal axis 374. A small opening in the rear insulator 312 near the back end 372 of the connector 300 at the longitudinal axis 374 forms a target 376 that is near the back end 372.

The connector 300 also includes a contact 308 that is an integral part of the connector 300 when shipped. The contact 308 does not extend beyond the front end 370 of the connector 300 when in the "as shipped" state. As a result, the body 304 of the connector 300 protects the contact 308 from damage during shipment. The connector 300 also includes an insulator body 306 that supports a front portion of the contact 308 and maintains the contact 308 along the longitudinal axis 374 of the connector 300. The insulator body 306 is a generally tubular support made of electrically insulative material. The contact 308 has an inner surface 378 defining a cylindrical bore 380 along the longitudinal axis 374 of the contact 308. The cylindrical bore 380 includes a narrower portion 382 nearest the back end of the contact 308, and a wider portion 384 closer to the front end 370 of the contact 308. The connector 300 includes spring clip, or clip 310 mounted within the narrower portion 382 of the bore 380. The clip 310 is described in more detail in U.S. Pat. No. 7,153,159, assigned to the same assignee as the current assignee, the contents of which are expressly incorporated by reference herein.

The rear insulator 312, the contact 308 and the clip 310 together make up a contact assembly. The contact assembly is capable of moving longitudinally as a unit relative to the body 304. The components of the connector 300, except for the clip 400, the reasons for which are discussed below, are pre-assembled in the factory. While the adapter 302 is shown attached to the connector 300, it can be easily removed from the connector 300 during installation of the coaxial cable and then easily replaced by the craftsman.

Figure 11:
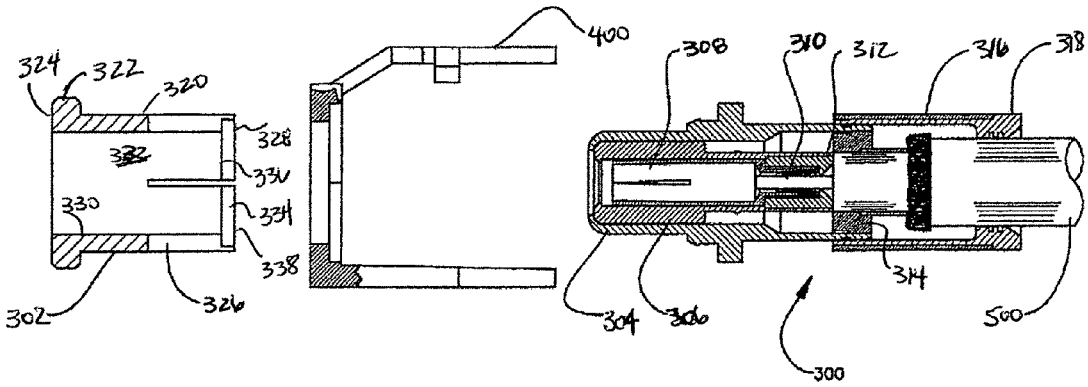
FIG. 11 is cross-sectional view of the connector of FIG. 7 with a coaxial cable field installed and prior to installation of an external clip.

FIG. 11 illustrates the connector 300 with the coaxial cable 500 installed in the connector, and ready for the connector 300 to be axially compressed. The clip 400 is also ready to be attached to the connector 300, and since the clip 400 can be installed in the field based on the construction of the connector 300, the craftsman can choose the color and appropriate configuration of the partially recessed engagement portion (if necessary) of the clip 400. Therefore, the craftsman need only carry a limited number of clips 400 and connectors 300 to ensure a sufficient supply at the job site. The adapter 302 has a main body 320, an annular projection 322 at a back end 324, and a plurality of slits 326 extending from the front end 328 toward the back end 324. The annular projection 322 allows for engagement with an installation tool, not shown, but it may not be needed with certain installation tools. The adapter 302 has an inner surface 330 that defines an opening 332 in a first portion of the adapter 302 that is sized to the appropriate connector. For example, the opening 332 for an adapter 302 for a BNC connector will be larger than that for an RCA connector. The adapter 302 also preferably has a second portion 334, wherein the inner surface 330 defines a second opening with a diameter that is larger than the first portion. A first forward facing surface or shoulder 336 is defined by the junction of the first and second portions of the inner surface 330 of the adapter 302. A second forward facing surface 338 is formed by the front end 328 of the adapter 302.

Figure 12:
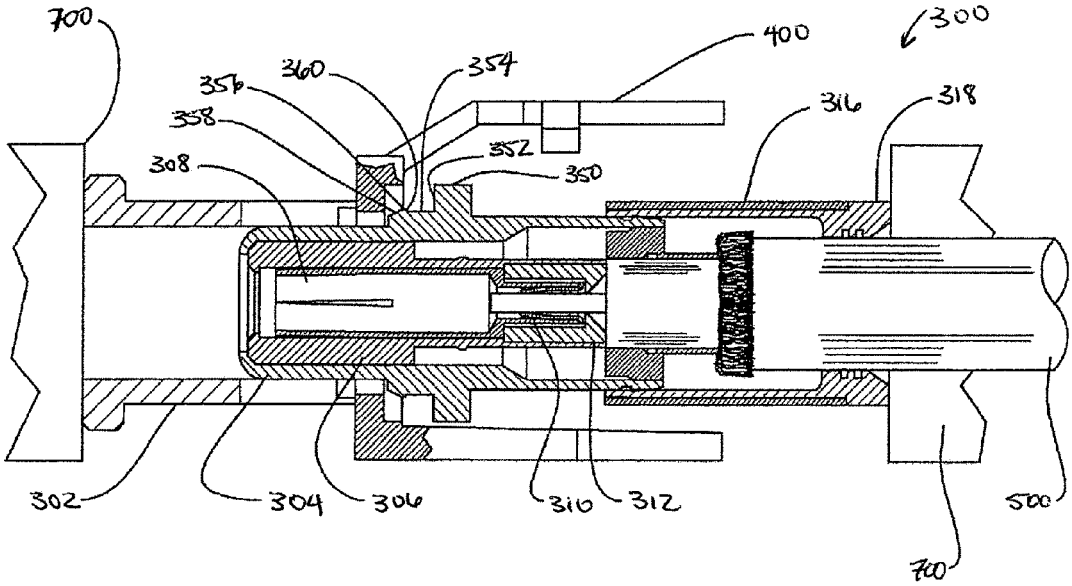
FIG. 12 is a cross-sectional view of the connector of FIG. 7 just prior to compression.

FIG. 12 is a partial cross-sectional illustration of the connector 300 partially installed on cable 500 in the field and fitted into an industry standard compression tooling 700 ready for finally assembly with clip 400 and compression onto cable 500. Clip 400 is installed about body 304 and adaptor 302 has been replaced onto connector body 304 and placed in position in preparation for final assembly by compressing, or bringing towards each other, tool jaws 700. Use of adaptor 302 permits various connector interfaces to be utilized with standard compression tooling and eliminates the need for extraneous loose tooling pieces often required in the field which are lost and subsequently must be replaced at considerable cost.

As previously mentioned and as illustrated in FIG. 12, the body 304 of connector 300 includes an external gripping portion 350 having a forward facing surface 352 and a annular groove 354 between the gripping portion 350 and an annular projection 356. The annular projection 356 also has a chamfered or tapered area 358 and a rearward facing surface 360. The external gripping portion 350 is illustrated as being hexagonal in configuration, but may be of any appropriate shape or configuration, including hexagonal, polygonal, square, or even knurled. The partially recessed engagement portion 410 of the clip 400 engages the external gripping portion 350 of the body 304 thereby preventing the clip 400 from rotating relative to the body 304. Thus, the partially recessed engagement portion 410 of the clip 400 and the external gripping portion 350 preferably have the same configuration. In the event that the external gripping portion 350 has a knurled configuration but is otherwise round, the partially recessed engagement portion 410 should similarly be round and sharp points on the knurled portion will engage the partially recessed engagement portion 410 of the clip 400.

Figure 13:
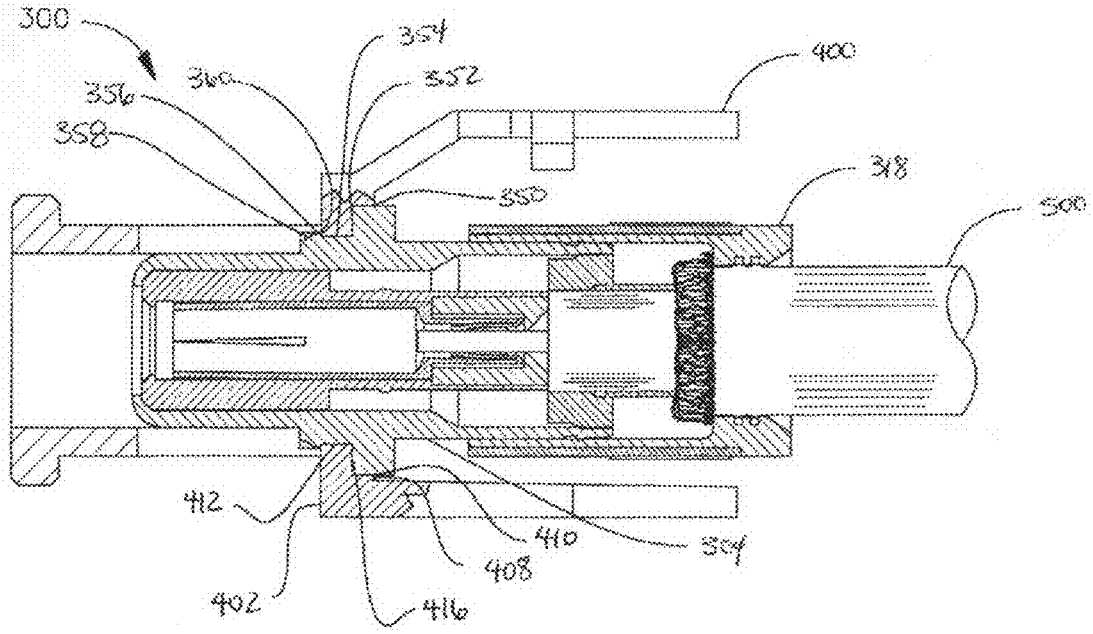
FIG. 13 is a cross-sectional view of the connector of FIG. 7 with a coaxial cable field installed and prior to compression.

When the tool 700 is activated as illustrated in FIG. 13, the forward facing surface 338 formed by the front end 328 of the adapter 302 pushes on the front face 402 of the clip 400, where the tapered area 358 of the annular projection 356 guides through-bore 412 of clip 400 toward the annular groove 354. Through-bore 412 of clip 400 is smaller in diameter than annular projection 356 on body 304. Clip 400 is made from a plastic material that is resilient enough to allow annular projection 356 to be forced through through-bore 412 then constrict about annular groove 354. As noted above, the external gripping portion 350 of body 304 (illustrated as a hexagonal configuration) is aligned within partially recessed engagement portion 410 of clip 400 preventing body 302 from rotating within through-bore 412 of clip 400. Rearward motion of body 304 is prevented by the engagement of rearward facing surface 360 of body 304 and front face 402 of clip 400. Forward motion of body 304 is prevented by the engagement of forward facing surface 352 and the rear face 408 of clip 400.

Once the clip 400 has been moved in the annular groove 354 by the second forward facing surface 338 of the front end 328 of the adapter 302, the first forward facing surface or shoulder 336 of adapter 302 makes contact with the front facing surface of the annular projection 356 (and the second forward facing surface 338 is still in contact with the clip 400). At this point, continued activation of the tool 700 causes the axial movement of the connector 300 components to secure the coaxial cable 500 in the connector 300. As an alternative, the adapter 302 may have only one forward facing surface that moves the clip 400 into the annular groove 354 and continues to press on clip 400 and body 304 to axially compress the connector 300.

Figure 14:
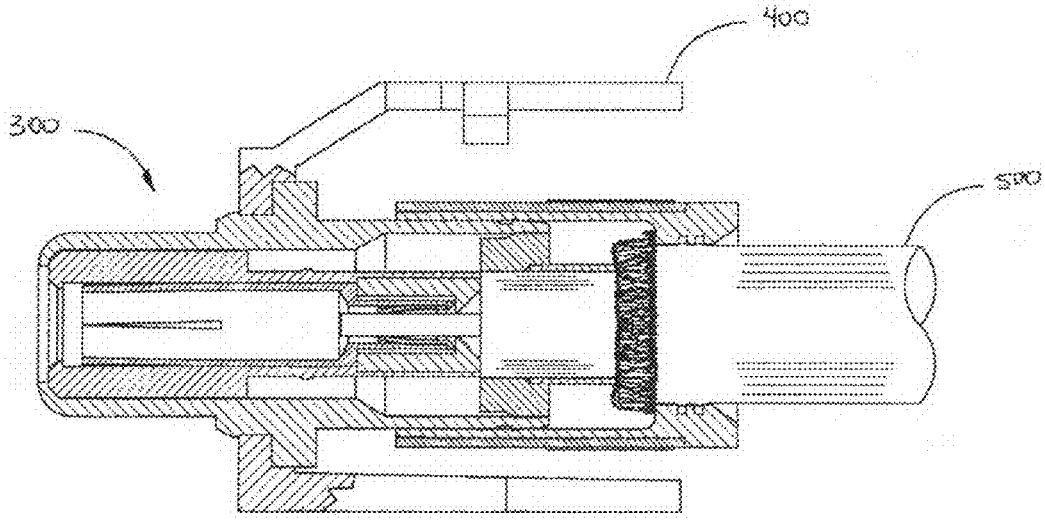
FIG. 14 is a cross-sectional view of the connector of FIG. 7 after compression and ready for installation.

FIG. 14 illustrates the connector 300 in a final state and the tool 700 and adapter 302 removed. The adapter 302 can be made of plastic, so that the adapter 302 can be discarded after use. The connector 300 is ready to be installed or snapped onto a wall plate.

Figure 15:
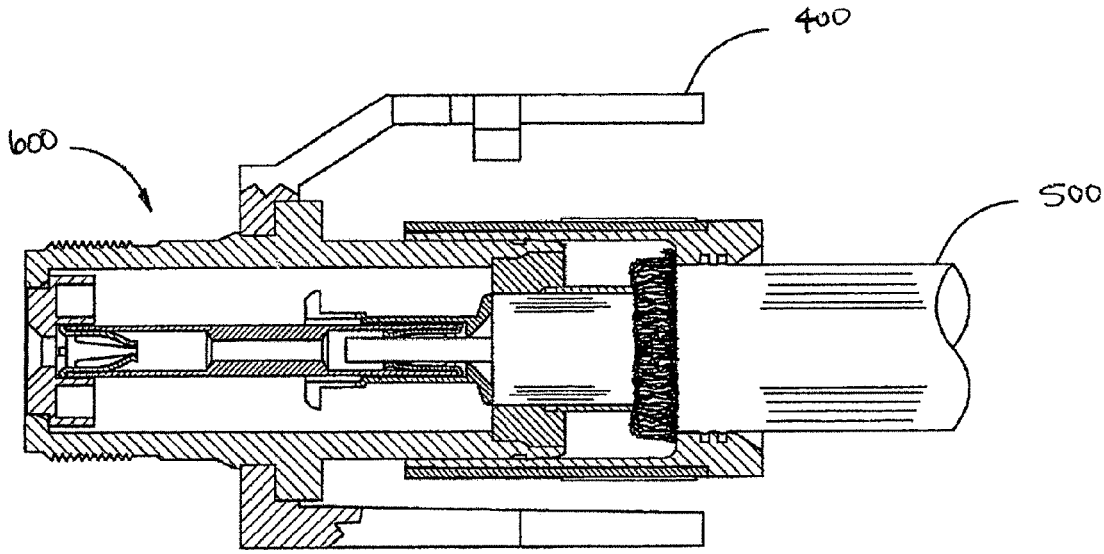
FIG. 15 is a cross-sectional view of another embodiment of a connector according to the present invention.

FIG. 15 illustrates another connector 600 according to the present invention. The connector 600 is a female Type F connector with the clip 400 being installed from the front and the connector 600 components having been installed from the rear of the connector 600. The attachment of the clip 400 and the compression of the connector 600 work in same manner as described above with respect to connector 300. The details of the internal components of connector 600 are similar to those described above for connector 300.

It will be apparent to those skilled in the art that various modifications and variations can be made to the present invention without departing from the spirit and scope of the invention. Thus it is intended that the present invention cover the modifications and variations of this invention provided they come within the scope of the appended claims and their equivalents.

What is claimed is:

1. A coaxial cable connector for attachment to a coaxial cable, the coaxial cable comprising a center conductor, a dielectric layer surrounding the center conductor, and an outer conductor surrounding the dielectric layer, the coaxial cable connector comprising:

a body having a front end, a back end, an external gripping portion, and a longitudinal opening extending between the front end and the back end along a longitudinal axis;

a post fixedly mounted within the longitudinal opening in the body from the back end of the body;

a contact assembly movably mounted to the post and capable of moving longitudinally relative to the body, the contact assembly capable of receiving the center conductor of the coaxial cable;

a compression ring mounted onto the back end of the body, wherein the compression ring surrounds but does not contact the post; and an external clip engaging at least a forward portion of the external gripping portion of the body and extending over the external gripping portion and toward the back end of the body.

2. The coaxial cable connector according to claim 1, wherein the body has an annular groove defined by the external gripping portion and an annular projection, the annular projection being disposed between the annular groove and the front end of the body, and wherein a portion of the external clip is disposed within the annular groove.

3. The coaxial cable connector according to claim 1, wherein the external gripping portion has a configuration from the group of configurations including hexagonal, square, polygonal, and knurled.

4. The coaxial cable connector according to claim 1, further comprising an adapter configured to be disposed on the front end of the coaxial cable connector body and to provide engagement with a tool to compress the coaxial cable connector, the adapter comprising:

a main body having a first end, a second end, and an interior surface defining an opening therethrough between the first end and the second end, the opening configured to pass over the front end of the coaxial cable connector;

an annular projection extending radially outward around the first end of the main body;

a first forward facing surface configured to engage at least one of a portion of the body of the coaxial cable connector and the external clip; and a rearward facing surface at the first end configured to engage the tool.

5. The coaxial cable connector according to claim 4, the adapter further comprising a second forward facing surface disposed radially outward of the first forward facing surface, the first forward facing surface configured to engage a forward facing surface of the body of the coaxial cable connector and the second forward facing surface configured to engage the external clip.

6. The coaxial cable connector according to claim 5, wherein the second forward facing surface contacts the external clip before the first forward facing surface contacts the forward facing surface of the body of the coaxial cable connector.

7. The coaxial cable connector according to claim 1, wherein the post has a largest outer diameter and the longitudinal opening in the back end of the body surrounds the largest outer diameter of the post.

8. A method of assembling a coaxial cable connector, comprising the steps of:

providing a coaxial cable connector having a body with a front end, a back end, an external gripping portion, and a longitudinal opening extending between the front end and the back end along a longitudinal axis, inserting a post into the body from the back end of the body;

mounting a compression ring onto the back end of the body, wherein the compression ring surrounds but does not contact the post;

inserting a contact assembly into the post so that the contact assembly is capable of moving longitudinally relative to the body;

inserting a coaxial cable into the contact assembly of the coaxial cable connector;

disposing an external clip over the front of the body of the coaxial cable connector; and axially compressing the connector thereby forcing the external clip into an annular groove in the body of the coaxial cable connector and axially compressing the coaxial cable connector to secure the coaxial cable in the coaxial cable connector.

9. The method of assembling a coaxial cable connector according to claim 8, further comprising the step of disposing an adapter over the front of the body of the coaxial prior to the step of axially compressing the connector, and wherein, in the step of axially compressing the connector, the adapter and the connector move relative to one another thereby forcing the external clip into an annular groove in the body of the coaxial cable connector and axially compressing the coaxial cable connector to secure the coaxial cable in the coaxial cable connector.

10. The method of assembling a coaxial cable connector according to claim 8, wherein, in the step of axially compressing the adapter and the connector, the external clip is forced into the annular groove before the coaxial cable connector is axially compressed.

11. The method of assembling a coaxial cable connector according to claim 8, wherein the step of disposing the external clip over the front of the body is performed after the step of inserting the coaxial cable into the contact assembly.

12. The method of assembling a coaxial cable connector according to claim 8, wherein the adapter contacts the external clip before it contacts the body of the coaxial cable connector.

13. The method of assembling a coaxial cable connector according to claim 12, wherein the adapter further comprises a second forward facing surface configured to engage the external clip on the coaxial cable connector, the second forward facing surface disposed radially outward of the first forward facing surface.

14. The method of assembling a coaxial cable connector according to claim 8, wherein the adapter comprises a main body having a first end, a second end, and an interior surface defining an opening therethrough between the first end and the second end, the opening configured to pass over a front end of the coaxial cable connector, a first forward facing surface configured to engage a structure on the body of the coaxial cable connector, and a rearward facing surface at the first end configured to engage the tool to compress the coaxial cable connector.

15. The method of assembling a coaxial cable connector according to claim 14, wherein the main body has a first portion having a first diameter and a second portion having a second diameter, the first diameter being smaller than the second diameter and the second portion being adjacent the second end and wherein the first forward facing surface is between the first portion and the second portion.

* * * * *